United States Patent [19]

Dola

[11] 4,370,009

[45] Jan. 25, 1983

[54] SLOTTED PLATE TERMINAL RENEWABLE AS SPADE TERMINAL

[75] Inventor: Frank P. Dola, Port Richey, Fla.

[73] Assignee: AMP Incorporated, Harrisburg, Pa.

[21] Appl. No.: 172,046

[22] Filed: Jul. 25, 1980

[51] Int. Cl.[3] ..... H01R 4/24

[52] U.S. Cl. ..... 339/31 R; 339/97 R

[58] Field of Search ..... 339/97 R, 97 C, 97 P, 339/98, 99 R, 31 R; 174/84 C

[56] References Cited

U.S. PATENT DOCUMENTS

| | | | |
|---|---|---|---|
| 3,289,151 | 11/1966 | Mas et al. | 339/31 R |
| 3,539,707 | 11/1970 | Kindell et al. | 174/84 |
| 3,825,881 | 7/1974 | Wigby | 339/97 R |
| 3,937,549 | 2/1976 | Hughes | 339/97 C |
| 3,950,065 | 4/1976 | Renn | 339/98 |
| 4,018,499 | 4/1977 | Rickards | 339/97 C |
| 4,159,158 | 6/1979 | Weidler | 339/97 P |
| 4,264,118 | 4/1981 | Nijman | 339/99 R |

FOREIGN PATENT DOCUMENTS

| | | | |
|---|---|---|---|
| 2344381 | 3/1974 | Fed. Rep. of Germany | 339/99 R |

*Primary Examiner*—John McQuade

*Attorney, Agent, or Firm*—F. Brice Faller

[57] ABSTRACT

Slotted plate terminal for insulated stranded wire has folded side edges on either side of the slot and a slit in each edge which leads to a circular aperture adjacent each wall of the slot. Wire is terminated by insertion into slot and retained therein by bending side edges to close slot. Slotted portion may be severed at score line leaving spade type terminal suitable for mating with standard clip.

6 Claims, 8 Drawing Figures

64
51
50
48
64
46
24
58
58
24
46
54'
20
20
54
44
40
55
55
6
48
50
6
40
48
12
26
50
51
16
16
51
40
44
36
44

38

38
32
32
64
64

42
44
55
50
58
58
24
24
54
54
28
28
52
52
40
10
16
56
46
46
56
56
34
36
34
38
45
32

SLOTTED PLATE TERMINAL RENEWABLE AS SPADE TERMINAL

BACKGROUND OF THE INVENTION

The present invention relates to a solderless electrical connection, and particularly to a slotted plate terminal for stranded wire which may be converted to a spade terminal.

Slotted plate terminations which displace insulation from insulated solid core or twisted strand conductor are now well established in the art. The main advantage of such connectors is that they may be terminated by a relatively simple wire insertion operation, avoiding soldering, crimping, or providing a mating terminal on the wire being terminated. It has been found, however, that slotted plate terminations for solid core wire are not equally suitable for stranded wire. This is because it is generally desirable for the beams, that is, the contact members which bear on the wire, to do so resiliently. This maintains contact integrity during the life of the termination quite effectively for solid core wire. In stranded wire, however, the strands tend to fall into a line under the bearing force of the beams, and contact integrity is lost unless special design features are present.

When wires are inserted into terminals of a slotted plate connector, considerable forces are imposed on the terminal by reason of fact that the insulation is being displaced, and the conductor is being forced into a generally undersized slot. These forces may be counteracted by design features of a housing where the terminal cooperates with a housing thereon, as in U.S. Pat. No. 4,159,158. A free standing terminal, by reason of its lack of housing support, generally cannot be terminated as effectively without the use of special tooling, and is not readily repairable since the original slot geometry cannot usually be recovered.

In some applications, such as where terminals are not in a closely spaced environment and ready access for repair is desirable, individual housings are not economically practicable. Consider, for example, a home appliance such as a dishwasher. A cheap factory termination not requiring a housing which would be readily repairable by a field serviceman would be most desirable.

SUMMARY OF THE INVENTION

The present invention is directed to a free standing slotted plate terminal for stranded wire which is renewable as a spade terminal. Folded edges on the terminal provide the support necessary to prevent failure during wire insertion. The bottom of the wire terminating slot is located slightly below slits in the sides of the terminals so that when normal force is brought to bear on the side edges the bundle of strands in the wire will be entrapped and constricted within the bottom of the slot as the top of the slot closes on them. A low normal force exists on the strands in the bottom of the slot so that the possibility of the strands rearranging or stacking is minimized. The terminal is provided with V-notches which act as latch points for insertion tooling which can be used to eliminate stress normal to the mounting surface and also to provide additional lateral support during wire insertion. A score line between the V-notches facilitates breaking off of the slotted plate portion leaving a standard spade terminal if it is desired to renew the termination.

It is therefore an object of the present invention to provide a wire-in-slot termination for low cost factory application of stranded wire. It is a further object to provide a wire-in-slot termination which may be converted to a spade type terminal for disengageable mating with a standard female clip.

It is a related object to provide a wire-in-slot terminal which is readily repairable in the field with standard tools.

The accomplishment of these and other objects will be apparent upon examination of the accompanying drawings and description which follow.

BRIEF DESCRIPTION OF THE DRAWINGS

FIG. 3 is a perspective of several mounted terminals in various stages of use.

DETAILED DESCRIPTION OF THE PREFERRED EMBODIMENT

Figure 1:
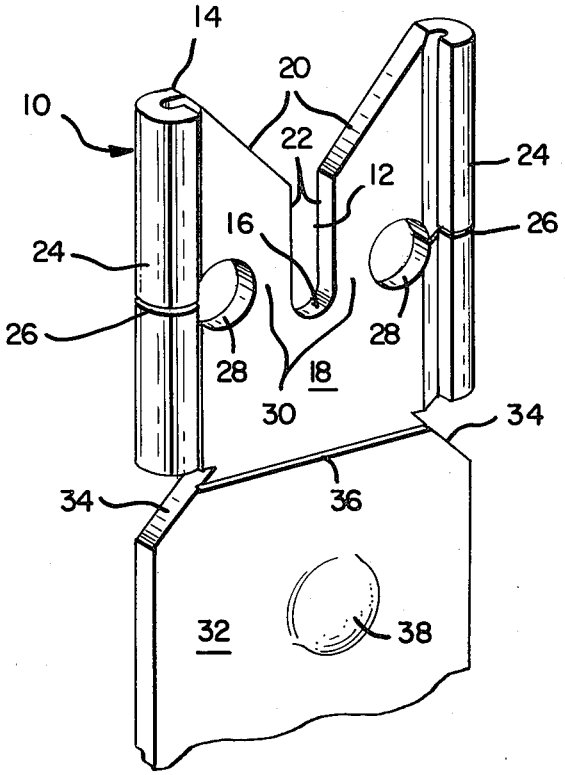
FIG. 1 is a perspective of the preferred terminal prior to wire insertion.

The terminal 10 of the preferred embodiment, shown in FIG. 1 is stamped and formed from sheet metal to make a plate having a wire receiving slot 12 extending inward from wire receiving end 14 to the bottom 16 of the slot which lies adjacent base portion 18 of the terminal. The slot 12 is profiled with lead-in ramps 20 which define a wire entry and parallel walls 22 which define wire contacting means for establishing electrical contact with an insulated wire. The terminal has side edges 24 which are folded over parallel to the slot 12 and base portion 18 to form a double plate thickness at the edges only. The side edges 24 are each formed with an indentation in the form of linear slit 26 which is cut perpendicular to the edge and extends to a circular aperture 28 between the side edge 24 and the wire receiving slot 12. The apertures 28 are spaced equidistant from the slot 12 on opposite sides thereof slightly offset from the bottom 16, forming pivot sections 30 between the apertures 28 and the slot 12, on opposite sides thereof.

Referring still to FIG. 1 the terminal is profiled with opposed V-notches 34 immediately below the folded side edges 24 of the terminal. A score line 36 extends between the V-notches 34 perpendicular to side edges 24 and defines a boundary between the base portion 18 and a tab portion 32 of the terminal 10. The tab portion 19 is profiled with a dimple 38. Portions of the terminal below the tab portion may be configured in numerous ways not material to the present invention, suitable for mounting and connection to conductors.

Figure 2:
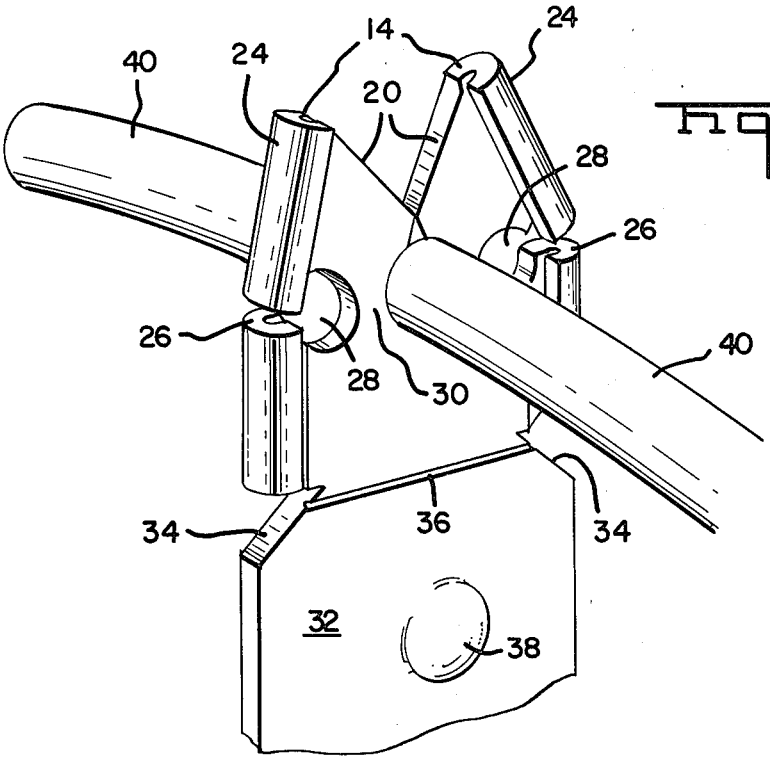
FIG. 2 is a perspective of the terminal subsequent to insertion and crimping.

The terminal 10 may be used to terminate a stranded core insulated wire 40 as shown in FIG. 2. This is accomplished by inserting the wire through the wire entry formed by lead-in ramps 20 and into wire receiving slot 12 to the bottom 16. Force is then brought to bear on side edges 24 toward wire receiving end 14 which closes the slot 12 to retain the wire 40 therein by bending the terminal at pivot sections 30. FIG. 3 depicts the terminal in various stages of use. Tooling 42 is shown poised over a terminal 10 in preparation for wire insertion and bending for wire retention. Should it be desired to repair such a termination or terminate a different wire to the terminal 10, the terminal may be severed by bending it at the score line 36, leaving a tab portion 32 in the form of a spade type male electrical terminal suitable for mating with a standard clip-type connector 33 as shown.

Referring still to FIG. 3, salient features of the tooling 42 include inner box member 44 having a U slot 45 therein for reception of wire 40. The box 44 has an inside profiled to accommodate a terminal 10 and a clip 46 thereon which permits resilient expansion of opposed crimp arms 52 about crimp arm pivots 54. A stuffer 48 is slideably mounted inside box 44 and an outer box member 55 is telescopically mounted on the outside of box 44.

Figure 7:
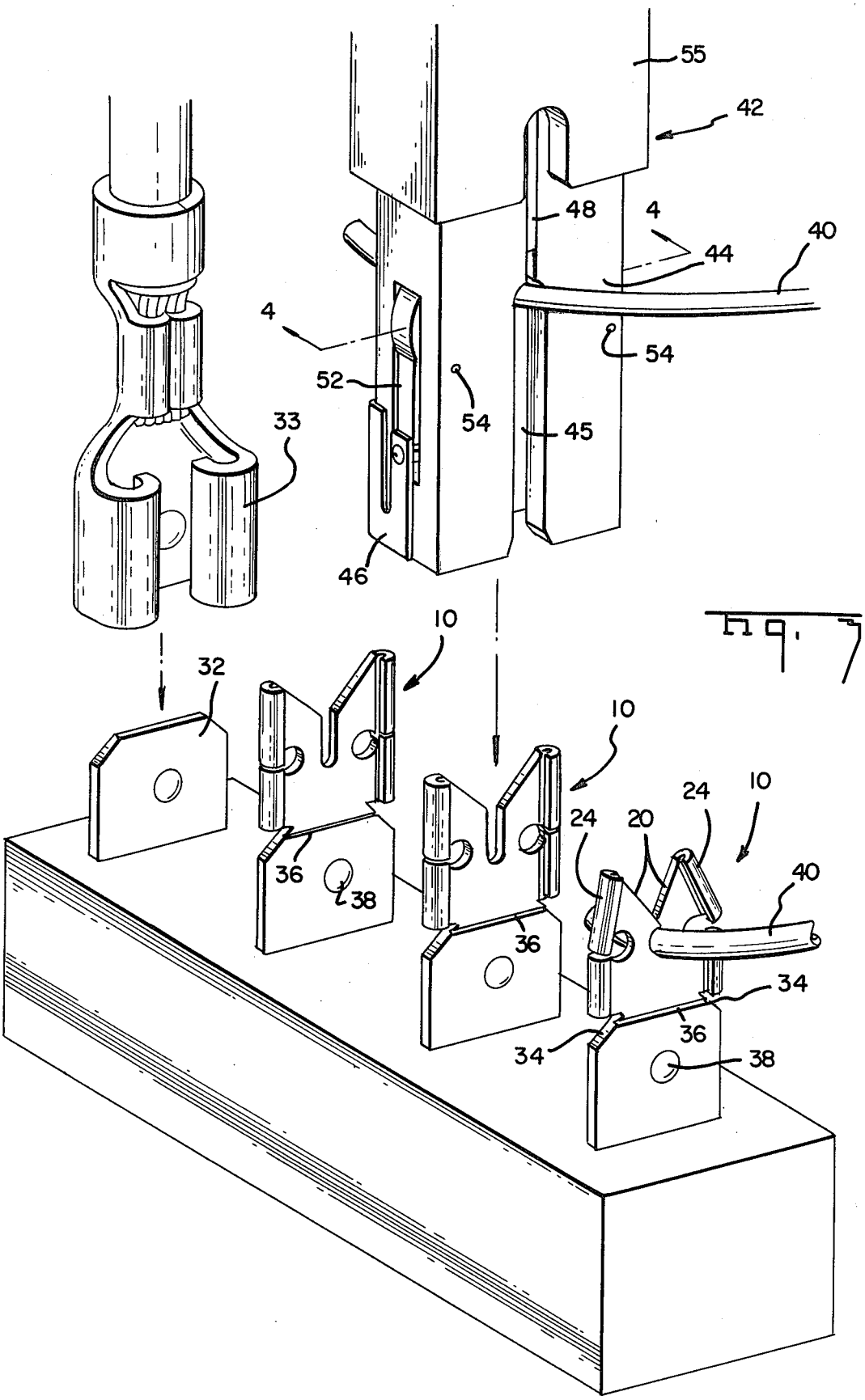
FIG. 7 is a view similar to FIG. 5, subsequent to wire insertion.
Figure 4:
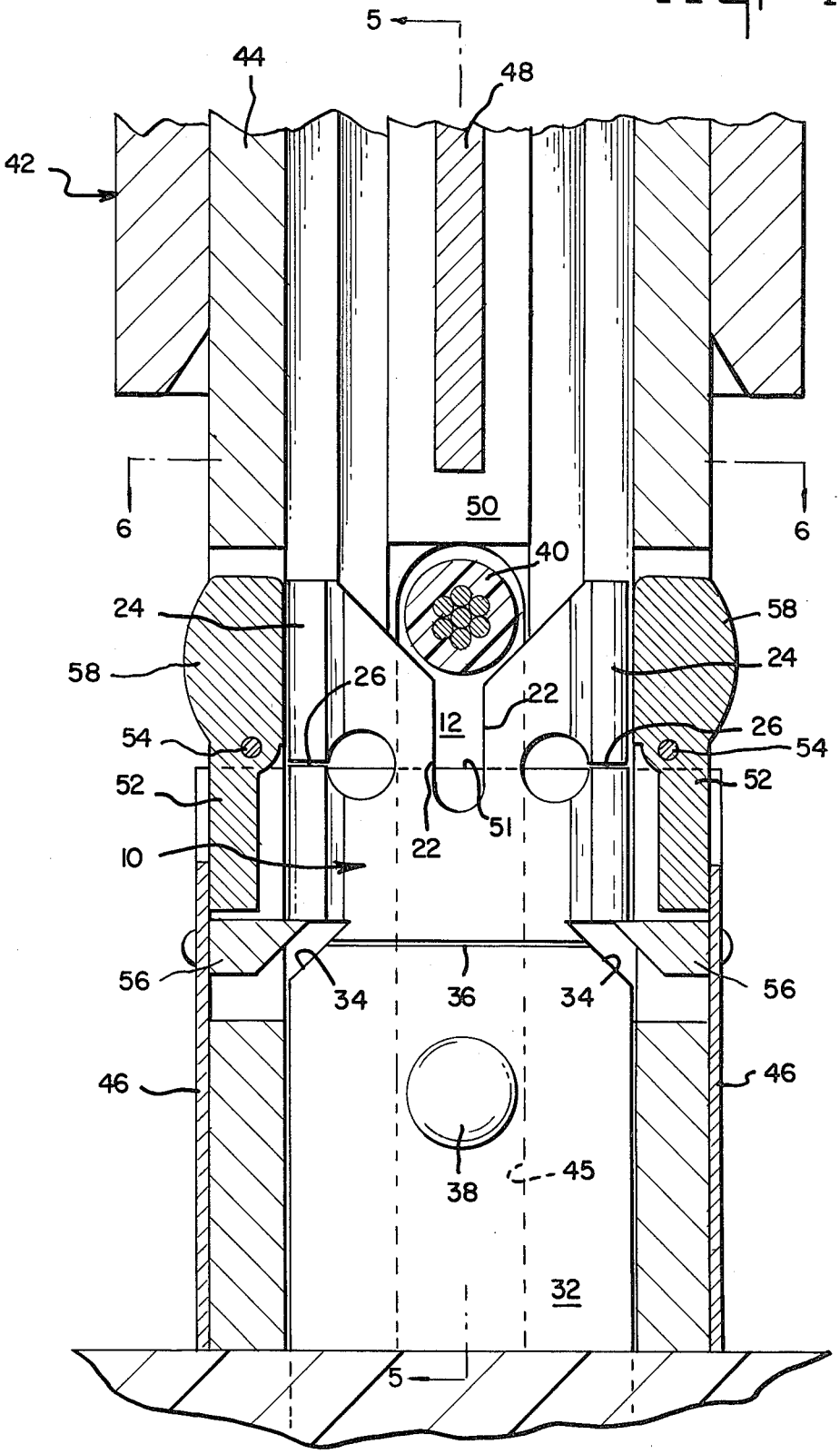
FIG. 4 is a cross sectional view of the tooling taken along line 4—4 of FIG. 3, shown on a terminal just prior to wire insertion.
Figures 5, 6, 7:
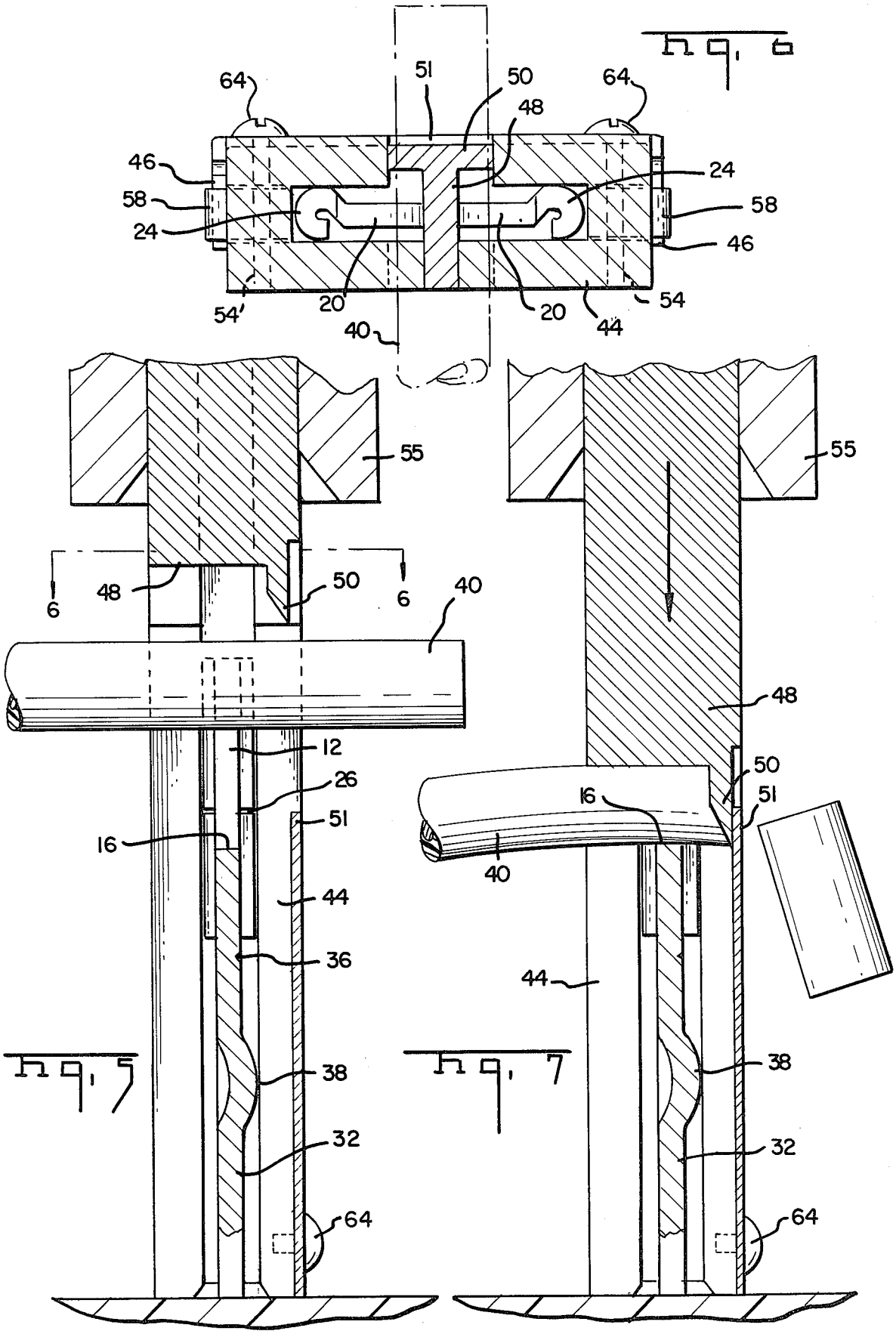
FIG. 5 is a cross sectional view of the tooling and terminal taken along line 5—5 of FIG. 4.
FIG. 6 is a cross sectional view taken along line 6—6 of FIG. 5.

FIG. 4 is a cross section of the tooling 42 as received on a terminal. Latches 56 on the inside of clip 46 catch in V notches 34 of the terminal as the stuffer 48 and integral shear 50 are poised above the wire just prior to insertion in the wire receiving slot 12. This stage of operation is shown from other angles in FIG. 5 and FIG. 6. Note that the wire 40 must be inserted in the tooling 42 above backplate 51, which is integral with clip 46 and secured to box 44 by screws 64. FIG. 7 is a view similar to FIG. 5 after the stuffer 48 is pushed down, which inserts the wire 40 into the wire receiving slot 12 and also shears off the leading end of the wire between the shear 50 and the backplate 51. The act of insertion displaces the insulation from the wire and causes the parallel walls 22 of the slot to make electrical contact with the conductive core of the wire. During insertion, the terminal is prevented from lateral distention by the double thickness of the folded side edges 24 on either side of linear slits 26 as the walls of the slits bear against each other.

Figure 8:
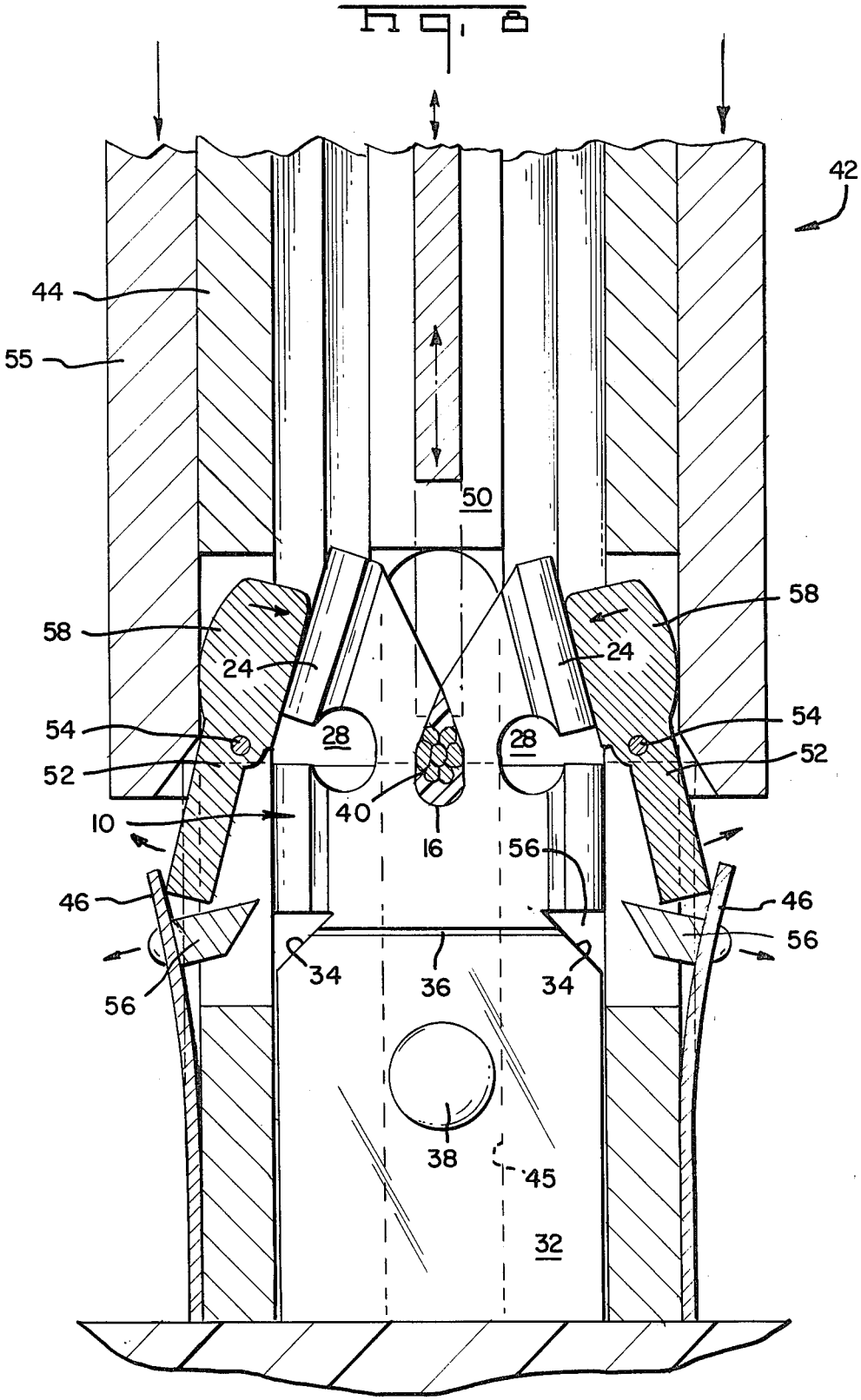
FIG. 8 is a view similar to FIG. 4, subsequent to wire insertion and crimping.

FIG. 8 depicts the final stage of operation of the tooling 42 as the outer box member 55 is telescopically received over the inner box member 44 and bears against humps 58 which causes the tops of the crimp arm 52 to move inward and bear against the side edges of the terminal 10. The terminal thus bends at pivot sections 30 as the slot closes over the wire to retain it in the bottom 16. The folds on the side edges 24 reinforce same against bending as the lateral forces are brought to bear by the tops of the crimp arms 52. The circular apertures 28 distort due to tensile forces present in the pivot sections 30. Here the circular profile is critical, since a sharp irregularity could lead to a fracture. The bottoms of the crimp arms 52 swing out against the resilient action of the clip 46 and remove the latches 56 from the V notches 34 so that the tooling 42 may be removed from the terminal subsequent to termination. While the term "crimp" has been used hereinabove in conjunction with the bending of the terminal, it should be noted that the termination is an insulation displacing type and the bending is intended primarily as a retention and constriction function in this embodiment. Further, much lower forces are involved than in a conventional crimping operation, and low normal forces bear on the wire as it is terminated in the bottom of the slot.

What is claimed is:

1. A one piece stamped and formed electrical contact terminal having wire contacting means for establishing electrical contact with an insulated wire comprising:

a plate having a wire receiving end, a base portion, and opposed side edges, said plate having a wire receiving slot extending inwardly from said wire receiving end toward said base portion, said slot having opposed walls spaced to make contact with the conductive core of an inserted wire, said slot having opposed lead-in ramps extending inwardly from said wire receiving end and converging toward said walls, said ramps defining a wire entry, said slot terminating at a bottom remote from said wire receiving end, said plate having an indentation in at least one of said side edges opposite said slot and slightly offset from the bottom thereof toward said wire receiving end defining a pivot section between said indentation and said slot, said indentation being configured as a linear slit extending laterally of said side edge to a circular aperture between said side edge and said pivot section, whereby, said insulated wire may be moved laterally of its axis, through said wire entry and between said walls, displacing the insulation on the wire, until said wire reaches the bottom of the slot, said linear slit preventing distention of the wire receiving slot during wire insertion, whereupon a lateral force brought to bear against said side edge having said indentation therein will cause the section of said plate between said wire receiving end and said pivot section to deflect laterally about said pivot section and retain the wire in the bottom of the slot, said circular aperture preventing tensile fracture of said pivot section during lateral deflection of the section of plate between the wire receiving end and the pivot section.

2. A terminal as in claim 1 wherein said side edges adjacent said slot and said base portion are folded over to form a double plate thickness at said edges.

3. A terminal as in claim 1 wherein said plate has indentations in each of said side edges, said indentations being directly opposed and equidistant from said wire receiving end, whereby said sections between said wire receiving end and said indentations will each deflect toward the other to close the slot.

4. A terminal as in claim 1 wherein said plate has a tab portion contiguous with said base portion, said tab portion being configured as a spade type male electrical terminal, whereby said plate may be severed between said tab portion and said base portion to form a spade type male electrical terminal.

5. A terminal as in claim 4 wherein said plate is scored between the base portion and the tab portion to facilitate severing the terminal.

6. A terminal as in claim 5 wherein said plate has a notch in each side edge between the base portion and the tab portion.

* * * * *